US005398884A

United States Patent [19]

Stanford

[11] Patent Number: 5,398,884

[45] Date of Patent: Mar. 21, 1995

[54] EDGE REINFORCING ENDCAP FOR DISPENSING FILM

[75] Inventor: Stone Stanford, Fort Lauderdale, Fla.

[73] Assignee: Mima Incorporated, Glenview, Ill.

[21] Appl. No.: 77,662

[22] Filed: Jun. 18, 1993

[51] Int. Cl.[6] ..... B65H 75/40

[52] U.S. Cl. ..... 242/588; 242/600; 242/614

[58] Field of Search ..... 242/96, 99, 68, 68.1, 242/68.2, 68.3, 68.5, 588, 600, 614; 53/204, 409, 581; 156/577, 579

[56] References Cited

U.S. PATENT DOCUMENTS 3,916,601 11/1975 Thimon ..... 53/204
4,845,920 7/1990 Lancaster ..... 53/399
4,905,451 3/1990 Jaconelli et al. ..... 53/410

FOREIGN PATENT DOCUMENTS 0544379 6/1993 European Pat. Off. ..... 53/409

*Primary Examiner*—Daniel P. Stodola
*Assistant Examiner*—John P. Darling
*Attorney, Agent, or Firm*—Schwartz & Weinrieb

[57] ABSTRACT

An endcap for simultaneously dispensing and hemming film from a roll while an operator is wrapping a load. An endcap is inserted into each end of a roll of film and an operator manually dispenses the film. The endcap includes an insert, a base, and a flange that hems the film. The flange is angled outwardly from the base of the endcap and overlaps an end portion of the roll so that when the film is dispensed, the edges of the film are hemmed.

20 Claims, 1 Drawing Sheet

EDGE REINFORCING ENDCAP FOR DISPENSING FILM

FIELD OF THE INVENTION

This invention is generally directed to an endcap that hems or reinforces an edge of a film as the film is being dispensed from a roll. The film may be used to wrap a symmetrical or non-symmetrical load. The endcaps are used in pairs and allow an operator to manually dispense the film. More specifically, the present invention is directed to an endcap that simultaneously gathers or hems and, thus, reinforces an edge of a film as it is being paid out. The terms "hem" or "hemming" as used herein, do not require a neatly folded margin, but rather include bunching or gathering of a film edge portion so as to reinforce the edge and reduce any possibility of tearing.

BACKGROUND OF THE INVENTION

Prior art devices that hem a film or a plastic sheet as it is being dispensed, for example U.S. Pat. Nos. 4,845,920 and 4,905,451, are well-known in the art. These prior art devices use a stationary hemming device to hem the film as it is being dispensed from a roll. A symmetrical package is rotated on a turntable and the hemmed film is dispensed from the roll and wrapped around the package in overlapping layers to encase the package.

While this type of prior art hemming device works well when wrapping symmetrical loads, it lacks the mobility that is needed when wrapping non-symmetrical loads. When wrapping a non-symmetrical load with a stationary hemming device, gaps may appear or the film may be loose since a stationary hemming device does not account for the angles created in a non-symmetrical load. Thus, when wrapping a non-symmetrical load, a mobile, portable hemming device is necessary to completely encase the package because the portable device allows an operator to wrap the package at different angles while maintaining the advantages of having a hemmed film.

The present invention is intended to overcome or minimize all the problems of the prior art, as well as to present several other improvements.

OBJECTS OF THE INVENTION

A general object of the present invention is to provide a novel endcap that allows an operator to manually dispense film from a roll.

Another object of the present invention is to provide a novel endcap that simultaneously hems a film as it is dispensed.

It is an object of the present invention to provide an endcap that allows an operator to stretch a film as it is being dispensed.

It is a further object of the present invention to provide an endcap that creates a hem that reinforces the edges of a film and prevents tearing.

It is a specific object of the present invention to provide an endcap that may be manufactured by a vacuum molding process.

SUMMARY OF THE INVENTION

Briefly, and in accordance with the foregoing, the present invention discloses an endcap for simultaneously dispensing and hemming or bunching or gathering edge portions of film from a roll while an operator is wrapping a load. An endcap is inserted into each end of a roll of film and an operator manually dispenses the film. The endcap, which is preferably molded in one piece, includes portions providing an insert, a base, and a flange that hems the film. The flange is angled outwardly from the base of the endcap and overlaps an end portion of the roll so that when the film is dispensed, the edges of the film are gathered or bunched and hemmed.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements throughout the several views, and in which.

DETAILED DESCRIPTION OF THE PREFERRED EMBODIMENT

Figure 1:
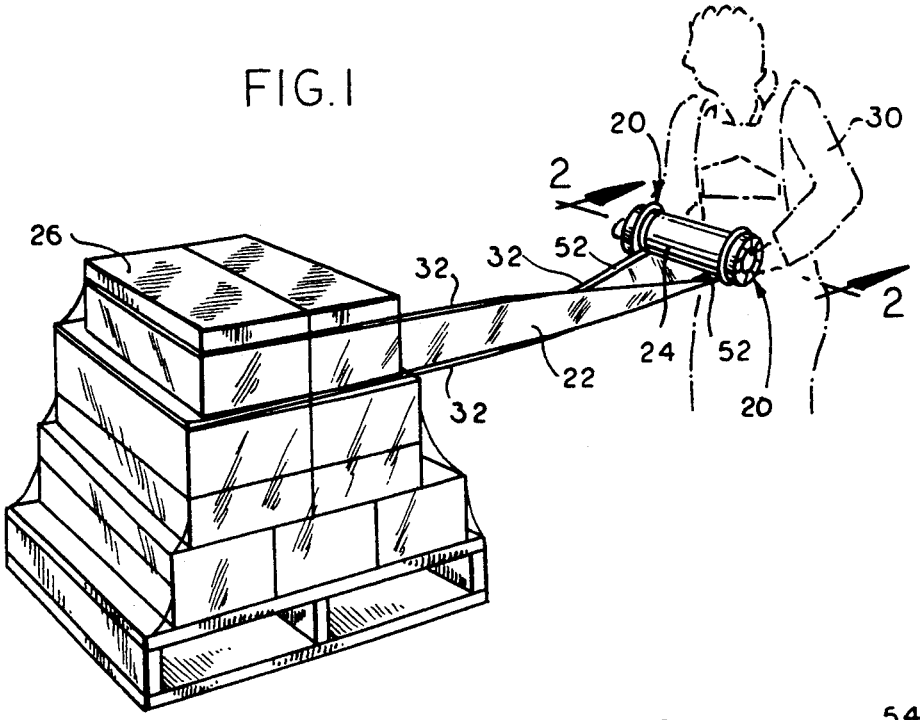
FIG. 1 is a perspective view of an operator dispensing and hemming film from a roll using a pair of endcaps according to the present invention.
Figure 2:
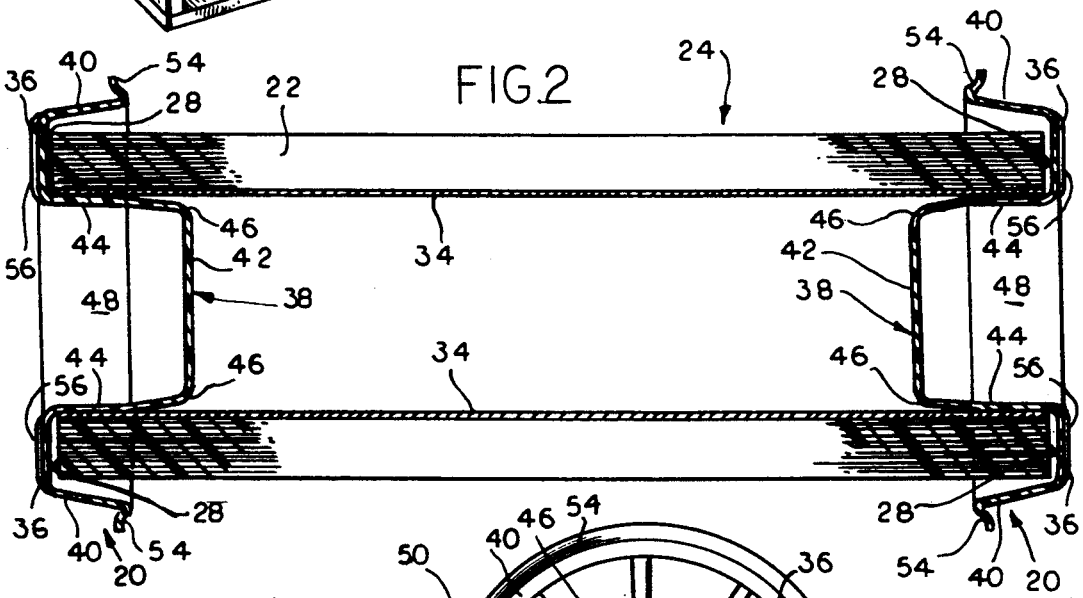
FIG. 2 is a cross-sectional view of the roll of film with the endcaps inserted into the roll along line 2—2 of FIG. 1.
Figure 3:
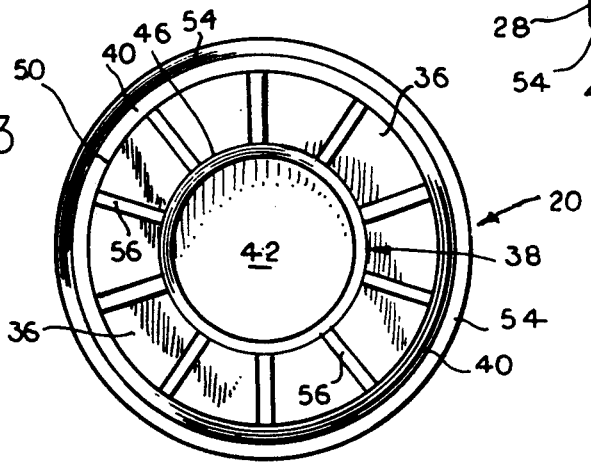
FIG. 3 is an top view of an endcap in accordance with the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

As shown in the Figs., the present invention is a novel endcap 20 that is used for simultaneously dispensing and hemming a film 22 from a roll 24 for wrapping a load or packages 26. The endcaps 20 are used in pairs with a single endcap 20 placed on each end 28 of the roll of film 24. An operator 30 manually dispenses the film 22 from the roll 24 and as the film 22 is dispensed or paid out, a hem 32 is simultaneously created by the endcaps 20. Since the endcaps 20 and roll of film 24 are portable, the operator 30 can wrap the load 26 and account for any angle created by the load 26. Thus, the operator 30 can completely encase the load 26. As shown in FIG. 1, when the film 22 is placed on the load 26, the bunched or gathered hem 32 is placed on the interior in order to insure that the hem 32 remains folded. The resulting hem 32 reinforces the edges of the film 22 and prevents the film 22 from tearing.

The roll of film 24 that is used in the present invention is well-known in the art and is generally comprised of a stretch film 22 wrapped around a hollow, cylindrical or tubular core 34. The film 22 is made of a suitable material, such as plastic, and is used for wrapping a load 26, such as packages and the like for transportation or storage. The load 26 may be symmetrical or non-symmetrical since the operator 30 manually dispenses the hemmed film 22 from the roll 24 and may take into account any angle created by the load 26 as described hereinabove.

The endcaps 20 are identical in form and are made of a single piece of material, preferably plastic. Each endcap 20 has a base or end abutting portion 36 which is integral with an insert 38 and an angled flange 40 that hems the film 22 as it is dispensed. When the endcaps 20 are inserted into the core 34 as described hereinbelow, they fit snugly and tightly against the ends 28 of the roll of film 24 and thus, the endcaps 20 will not slip or pop out of the roll 24.

The base 36 of the endcap 20 is generally disc-shaped. The diameter of the base 36 may vary depending on the size of the roll 24, however, the diameter of the base 36 should have a diameter that is at least as great as the outer diameter of the roll of film 24 for reasons described herein. The insert 38 protrudes outwardly from the center of the base 36 and is generally cup-shaped having a circular bottom wall 42 that defines an outer diameter attached to a side wall 44. At a junction 46 where the side wall 44 and the bottom wall 42 meet, the wall is curved in order to facilitate the entry of the insert 38 into the tubular core 34. When the insert 38 is completely inserted into the core 34, it fits tightly and concentrically within an inner diameter of the tubular core 34 and the face portion of the end of the roll 24 abuts the base 36. The size of the insert 38 may vary depending on the size of the tubular core 34 and roll 24, however, the insert 38 should be large enough to create a tight fit with the roll of film 24. The interior 48 of the cup-shaped insert 38 is hollow so that an operator 30 can place his fingers therein to allow the endcaps 20 and the roll of film 24 to spin around his hands when the film 22 is being dispensed.

The hemming flange 40 is integral with the periphery 50 of the base 36 and is angled outwardly therefrom on the same side as the insert 38. The hemming flange 40 overlaps a portion of the end 28 of the roll 24. The size of the flange 40 may vary depending on the desired hem 32 size or width. As the film 22 is dispensed, it contacts the angled flange 40 which causes the edge 52 of the film 22 to fold over itself or be bunched or gathered, thereby creating a hem 32. In order to prevent the flange 40 from tearing or damaging the film 22 as it is being hemmed, a free end or margin 54 of the flange 40 is rolled or radiused outwardly and back over the flange 40.

In the preferred embodiment, the base 36 includes strengthening ribs 56 thereon. The ribs 56 are equally spaced and extend radially outward from the insert 38 to the periphery 50 of the base 36. The strengthening ribs 56 protrude outwardly from the base 36 on the side opposite to the insert 38 and serve to stiffen the endcap and resist upward flexing of the flange 40 resulting from "hemming" forces on the flange.

Now that the construction of the endcaps 20 have been described in detail, the specifics of the manner of using the present invention will be described. First, an operator 30 inserts an endcap 20 into each end 28 of a roll of film 24. When the endcap 20 is completely inserted, the base 36 abuts the face portion of the end 28 of the roll 24, the insert 38 fits tightly within the core 34 and the hemming flange 40 overlaps a portion of the end 28 of the roll of film 24.

The film 22 is attached, by suitable means or by sticking the plastic directly to, the load 26 that is to be wrapped. The operator 30 walks around the load 26 paying out film 22, with the hem 32 on the interior, wrapping the load 26. To dispense the film 22, the operator 30 inserts his fingers into the hollow interior 48 of the cup-shaped insert 38 and allows the roll of film 24 and endcaps 20 to spin freely around his fingers. The operator 30 may squeeze the preferably smooth surfaces of flange 40 and wall 44 between his thumb and fingers to slow the speed at which the film 22 is being dispensed and/or to stretch the film 22. As the film 22 is dispensed from the roll 24, the film 22 contacts the angled flange 40 which causes the edges 52 of the film 22 to fold over itself and gather and bunch up, thereby creating a hem 32. When the operator 30 is finished wrapping the load 26, the film 22 is detached from the roll 24 by suitable means.

The endcaps 20 of the present invention present several other advantages over prior art devices in addition to the advantages described hereinabove. They are inexpensive, lightweight and disposable. Furthermore, the endcaps 20 can be manufactured by an inexpensive process, such as vacuum forming.

While a preferred embodiment of the present invention is shown and described, it is envisioned that those skilled in the art may devise various modifications of the present invention without departing from the spirit and scope of the appended claims. The invention is not intended to be limited by the foregoing disclosure.

The invention claimed is:

1. An endcap for dispensing and hemming film from a roll, said roll having opposite ends and a tubular core defining an inner diameter, said film being wrapped around said roll thereby defining an outer diameter, comprising:

an insertion means having a hollow interior and concentrically engaging said inner diameter of said roll;

an end abutting means integral with an outer end portion of said insertion means for abutting an end of said roll; and a hemming means integral with said end abutting means for hemming said film as it is dispensed from said roll.

2. An endcap as defined in claim 1, wherein the end abutting means has a diameter greater than the outer diameter of the roll.

3. An endcap as defined in claim 2, wherein the hemming means is a flange integral with the periphery of the end abutting means and angled outwardly thereof.

4. An endcap as defined in claim 3, wherein said hemming means overlaps an end portion of the outside diameter of the roll.

5. An endcap as defined in claim 4, wherein the flange includes a portion that is folded back over the edge of the flange.

6. An endcap as defined in claim 1, wherein said end abutting means has a plurality of strengthening ribs thereon.

7. An endcap as defined in claim 1, wherein an endcap is disposed on each end of the roll.

8. An endcap for dispensing and hemming film from a roll wherein said roll has opposite ends and a tubular core defining an inner peripheral surface having an inner diametrical extent, and said film is wrapped around said roll thereby defining an outer peripheral surface having an outer diametrical extent, comprising:

cup-shaped means for axial insertion into one end portion of said tubular core of said roll whereby sidewall portions of said cup-shaped means engage said inner peripheral surface of said tubular core, and a hollow portion of said cup-shaped means opens outwardly from said one end portion of said tubular core so as to be capable of receiving fingers of an operator using said endcap for dispensing film from said roll;

end-abutting means integral with an axially outward peripheral portion of said cup-shaped means for abutting an end portion of said roll; and flange means integral with said end-abutting means and overlying said end portion of said roll for hemming said film as said film is dispensed from said roll.

9. An endcap as set forth in claim 8, wherein:

said end-abutting means has an annular configuration; and said flange means is integrally connected to a radially outer peripheral portion of said annular end-abutting means.

10. An endcap as set forth in claim 8, wherein:

an endcap is axially disposed within each end portion of said tubular core of said roll.

11. An endcap as set forth in claim 8, wherein:

said end-abutting means has a plurality of strengthening ribs disposed thereon.

12. An endcap for dispensing and hemming film from a roll, the roll having opposite ends and a tubular core defining an inner diameter, said film being wrapped around said roll thereby defining an outer diameter, said endcap comprising:

an insertion means for engaging the inner diameter of the roll, said insertion means having a hollow interior;

an end abutting means integral with said insertion means for abutting an end of the roll, said end abutting means having a diameter greater than the outer diameter of the roll, and a hemming means for hemming the film as it is dispensed from the roll, said hemming means being a flange overlapping an end portion of the roll and integral with the periphery of the end abutting means and angled outwardly thereof.

13. An endcap as defined in claim 12, wherein said insertion means concentrically engages the inner diameter of the roll.

14. An endcap as defined in claim 12, wherein said end abutting means has a plurality of strengthening ribs thereon.

15. An endcap as defined in claim 12, wherein an endcap is disposed on each end of the roll.

16. An endcap as defined in claim 12, wherein the flange includes a portion that is folded back over the edge of the flange.

17. An endcap for dispensing and hemming film from a roll comprising:

a central section for engaging an end portion of the roll and centering the endcap with respect thereto;

an annular section extending outwardly from said central section for overlying an end of the roll, and an annular flange joined to and flaring from an outer margin of said annular section for overlying an end portion of the roll and forming a hem as film is paid out from the roll.

18. An endcap as defined in claim 16, wherein said central section is hollow and extends axially for insertion into said roll and for receiving fingers of an operator using the endcap for dispensing film.

19. An endcap as defined in claim 18, wherein at least one of said sections includes protuberances engagable by an operator for controlling rotation of the endcap during dispensing of the film.

20. An endcap as defined in claim 17, wherein said flange and said central section include oppositely facing surfaces squeezable between a thumb and finger of a workman for controlling rotation of the endcap as film is paid out from the roll.

* * * * *